US007817930B2

(12) United States Patent
Watanabe

(10) Patent No.: US 7,817,930 B2
(45) Date of Patent: Oct. 19, 2010

(54) IMAGE FORMING APPARATUS, CONTROL METHOD THEREFOR, AND PROGRAM

(75) Inventor: Kazuhito Watanabe, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 590 days.

(21) Appl. No.: 11/849,540

(22) Filed: Sep. 4, 2007

(65) Prior Publication Data

US 2008/0063416 A1 Mar. 13, 2008

(30) Foreign Application Priority Data

Sep. 8, 2006 (JP) ..... 2006-244708

(51) Int. Cl.
*G03G 15/00* (2006.01)

(52) U.S. Cl. ..... 399/45; 399/388; 399/389

(58) Field of Classification Search ..... 399/45, 399/81, 388, 389
See application file for complete search history.

(56) References Cited

U.S. PATENT DOCUMENTS 5,557,427 A * 9/1996 Kamiya ..... 358/496
6,871,042 B2 * 3/2005 Nemura et al. ..... 399/389
2006/0062585 A1 * 3/2006 Sone et al. ..... 399/69
2006/0158479 A1 * 7/2006 Yamaguchi ..... 347/19
2006/0251439 A1 * 11/2006 Sugiyama ..... 399/68

FOREIGN PATENT DOCUMENTS

JP 5-313517 A 11/1993
JP 6-110354 A 4/1994
JP 2003-312890 A 11/2003

* cited by examiner

*Primary Examiner*—David M Gray
*Assistant Examiner*—Francis Gray
(74) *Attorney, Agent, or Firm*—Canon USA Inc IP Division

(57) ABSTRACT

In an image forming apparatus, a type of paper conveyed through a conveying path is determined based on combination of sensing signals obtained from a plurality of sensing units. Each of the sensing units is movable between an actuating position and a retracting position as a paper is conveyed through a conveying path. Based on the type of paper determined based on combination of sensing signals obtained from the plurality of sensing units, a control unit of the image forming apparatus controls an image forming unit forming an image on the conveyed paper.

11 Claims, 12 Drawing Sheets

| | SENSOR 110 | SENSOR 111 |
|---|---|---|
| SUPER THICK PAPER | ON | ON |

| | SENSOR 110 | SENSOR 111 |
|---|---|---|
| THICK PAPER | OFF | ON |

| | SENSOR 110 | SENSOR 111 |
|---|---|---|
| PLAIN PAPER | OFF | OFF |

IMAGE FORMING APPARATUS, CONTROL METHOD THEREFOR, AND PROGRAM

BACKGROUND OF THE INVENTION

1. Field of the Invention

The present invention relates to an image forming apparatus (e.g., copying machine, printer, facsimile) having a function to sense a kind of paper conveyed through its conveying path, and a control method therefor, and program.

2. Description of the Related Art

Conventionally, an image forming apparatus such as a copying machine, a printer or a facsimile forms an image by transferring an image to a transfer paper based on image data read from an original or image data supplied from other information processing apparatuses. An image forming apparatus may use various types of transfer papers, including thick papers and plain papers. Each type of transfer paper may require different control condition for forming an image by the image forming apparatus.

In a conventional image forming apparatus, a control unit conducts optimal control depending on the type of transfer paper set by a user using an operation unit immediately before the image forming. Some image forming apparatuses employ a detecting unit that can directly detect physical properties of the transfer paper as numerical values in an electrical or mechanical manner and automatically conducts the optimal control.

Various types of techniques have been proposed of the above image forming apparatus (for example, Japanese Laid-Open Patent Publication (Kokai) No. 1994-110354, Japanese Laid-Open Patent Publication (Kokai) No. 2003-312890 and Japanese Laid-Open Patent Publication (Kokai) No. 1993-313517).

However, in the above conventional examples, a burden on (effort for) a user increases if the user is required to set the type of transfer paper used in an image forming apparatus. This makes it difficult to resolve setting mistake or accidental omission of setting. Additionally, if an image forming apparatus employs a detecting unit that directly detects physical properties of the transfer paper as numerical values in an electrical or mechanical manner, a problem may arise concerning a size of the detecting unit or cost increase of the image forming apparatus.

Furthermore, the conventional image forming apparatus may not accurately estimate appropriate working life of a component (time to replace the component) since the conventional apparatus does not consider that the life of a component will change that is installed in the image forming apparatus according to the type of transfer paper used. Because of this, replacement of a component not exceeding its working life causes a burden of extra cost to a user or continuous use of the component exceeding its working life induces a problem such as paper jam or a defective image.

SUMMARY OF THE INVENTION

An embodiment of the present invention provides an image forming apparatus, a control method therefor, and a program that can serve to contemplate improvement of the reliability of the image forming apparatus and reduction of life cost charged to a user of the image forming apparatus.

In a first aspect of the present invention, there is provided an image forming apparatus operable to convey a paper to an image forming unit through a conveying path to form an image. The image forming apparatus comprises a plurality of sensing units movable between an actuating position and a retracting position. Each respective sensing unit is configured to sense a paper by moving from the actuating position to the retracting position caused by the paper touching the respective sensing unit as the paper is conveyed through the conveying path. The image forming apparatus further comprises a control unit configured to determine a type of paper conveyed through the conveying path based on combination of sensing signals obtained from the plurality of sensing units, and to execute image forming control based on the determined type of paper.

According to an embodiment of the present invention, image forming control based on the determined type of paper is performed, thereby allowing for resolving wrong setting of paper in use or a problem such as growth in size or increase of cost of a unit for detecting physical properties of paper. This makes it possible to contemplate improvement of the reliability of the image forming apparatus and reduction of life cost charged to a user of the image forming apparatus.

In an embodiment, an image forming apparatus comprises a communication unit configured to communicate with a life estimating apparatus for estimating a life of a component used in the image forming apparatus. The life estimating apparatus performs the life estimation based on the determined type of paper if the communication unit receives the type of paper determined by the control unit. The control unit executes image forming control based on the life estimation.

In an embodiment, a notice of component replacement is displayed based on the life estimation.

In an embodiment, at least one of the plurality of sensing units has a sensing strength to sense a paper that is different from a sensing strength of the other sensing unit.

In an embodiment, a sensing strength of each respective sensing unit is adjustable.

In an embodiment, each of the plurality of sensing units comprises an adjusting unit configured to enable adjustment of an amount of movement between the actuating position and the retracting position.

In an embodiment, at least one of the plurality of sensing units is disposed on a peripheral side of a bent part of the conveying path.

In an embodiment, the control unit of the image forming apparatus sets an image forming condition for the image forming unit forming an image on the conveyed paper and a driving condition for a driving mechanism based on the determined type of paper.

In an embodiment, the control conditions based on the determined type of paper are selected from at least one of the group consisting a plain paper control condition to form the image on plain paper, a thick paper control condition to form the image on thick paper and a super thick paper control condition to form the image on thick paper that is thicker than the thick paper.

In a second aspect of the present invention, there is provided a control method for use in an image forming apparatus comprising a plurality of sensing units movable between an actuating position and a retracting position, and the image forming apparatus operable to convey a paper to an image forming unit through a conveying path to form an image. The method comprises the steps of sensing a paper by each respective sensing unit moving from the actuating position to the retracting position caused by the paper touching the respective sensing unit as the paper is conveyed through the conveying path, and determining a type of paper conveyed through the conveying path based on combination of sensing signals obtained from the plurality of sensing units.

In an embodiment, at least one of the plurality of sensing units has a sensing strength to sense a paper that is different from a sensing strength of the other sensing unit.

In an embodiment, the control method further comprises the step of executing image forming control based on the determined type of paper.

In a third aspect of the present invention, there is provided a program stored on a computer-readable medium, including instruction, which, when executed by an image forming apparatus, causes the image forming apparatus to execute a control method of the image forming apparatus.

The above and other objects, features, and advantages of the invention will become more apparent from the following detailed description taken in conjunction with the accompanying drawings.

BRIEF DESCRIPTION OF THE DRAWINGS

FIG. 2A is a drawing showing a conveyance state of super thick paper, while FIG. 2B is a drawing showing operation states of transfer paper detecting sensors.

FIG. 3A is a drawing showing a conveyance state of thick paper, while FIG. 3B is a drawing showing operation states of the transfer paper detecting sensors.

FIG. 4A is a drawing showing a conveyance state of plain paper, while FIG. 4B is a drawing showing operation states of the transfer paper detecting sensors.

DETAILED DESCRIPTION OF THE PREFERRED EMBODIMENTS

The present invention will now be described in detail with reference to the drawings showing preferred embodiments thereof. It should be noted that the relative arrangement of the components, the numerical expressions and numerical values set forth in these embodiments do not limit the scope of the present invention unless it is specifically stated otherwise.

The following will describe the embodiments of the present invention with reference to the drawings.

First Embodiment

Figure 1:
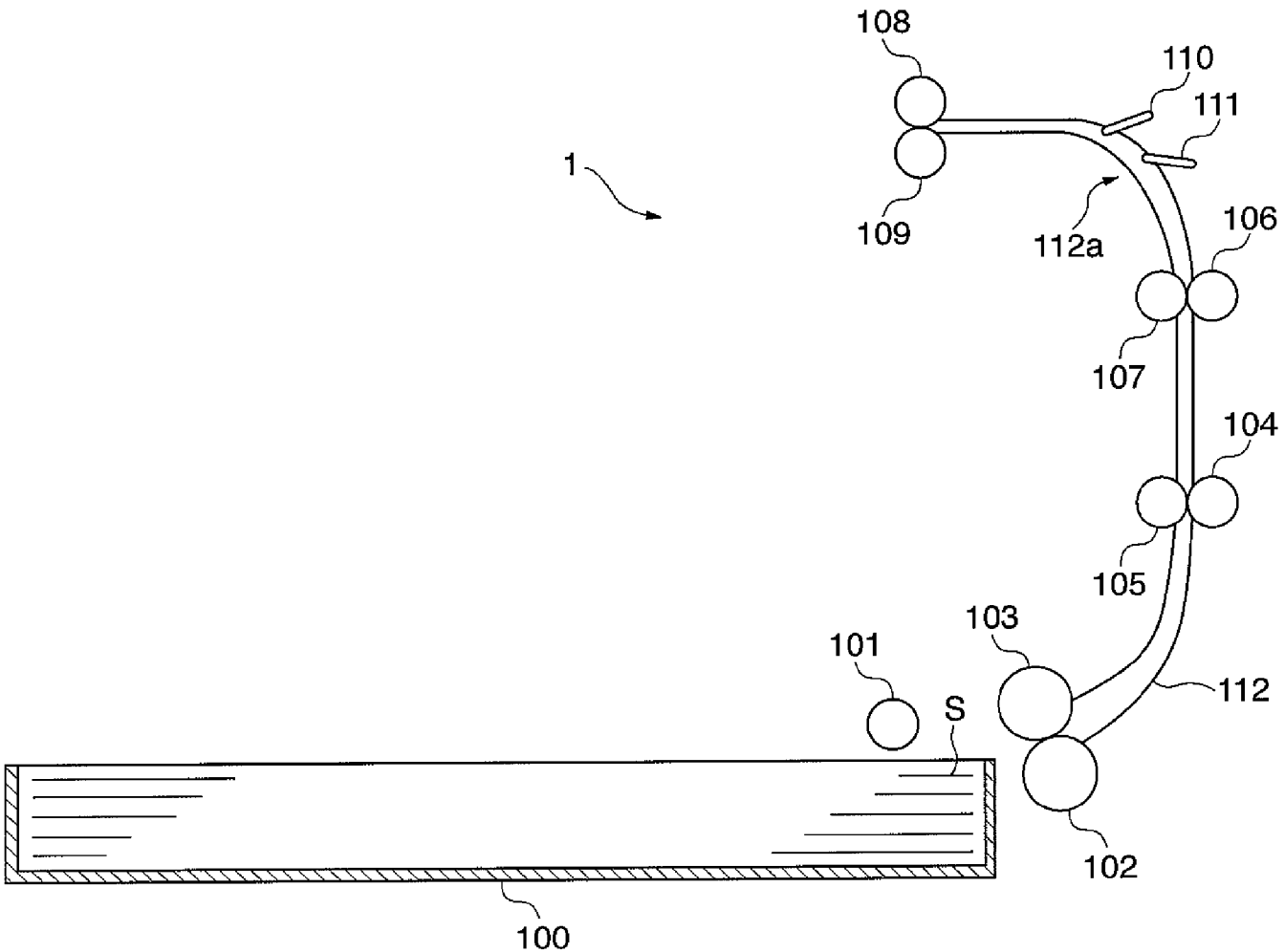
FIG. 1 is a configuration diagram of a conveying path of an image forming apparatus according to a first embodiment of the present invention.

FIG. 1 is a configuration diagram of a conveying path of an image forming apparatus according to a first embodiment.

In FIG. 1, an image forming apparatus 1 feeds transfer paper S set in a paper feed cassette 100 to an image forming unit (not shown, see FIGS. 5 and 6) through a conveying path 112, and forms an image through steps of such as transferring and fixing the image onto the transfer paper. In an embodiment, the image forming apparatus 1 is configured as a multi function peripheral having a plurality of functions (a copy function, a printer function, a FAX function, a scanner function and a network function).

Between the paper feed cassette 100 and the conveying path 112, paper feed rollers 101 through 103 are disposed. Along the conveying path 112, conveying rollers 104 through 109 are disposed. Further, around a bent part 112*a* of the conveying path 112, the transfer paper detecting sensors 110 and 111 are disposed. The transfer paper detecting sensors 110 and 111 switch their ON/OFF state depending on the type of the transfer paper S (in an embodiment, super thick paper, thick paper or plain paper) being conveyed through the bent part 112*a*.

The transfer paper detecting sensors 110 and 111 are configured as mobile sensors that are movable between an actuating position and a retracting position. The sensors 110 and 111 sense the transfer paper S (switch from OFF to ON) if the pushing force is a pre-determined value or more when the transfer paper S touches the sensors and accordingly the paper S moves from the actuating position to the retracting position. The transfer paper detecting sensors 110 and 111 are further equipped with an adjusting mechanism (not shown) to adjust the amount of movement between the actuating position and the retracting position. The transfer paper detecting sensors 110 and 111 use different pre-determined values (the strengths of sensing) described in the above at sensing the transfer paper S. The strengths of sensing by the transfer paper detecting sensors 110 and 111 can be varied as necessary.

The transfer paper S set in the paper feed cassette 100 is fed into the conveying path 112 through the paper feed rollers 101, 102 and 103. The transfer paper S fed into the conveying path 112 is conveyed to the image forming unit through the conveying rollers 104, 105, 106 and 107. Around the bent part 112*a* on the way that the transfer paper S is conveyed to the image forming unit via the conveying path 112, the transfer paper detecting sensors 110 and 111 sense the transfer paper S (switch ON/OFF), and determines the type of the transfer paper S based on the sensing result.

Figures 2A, 2B:
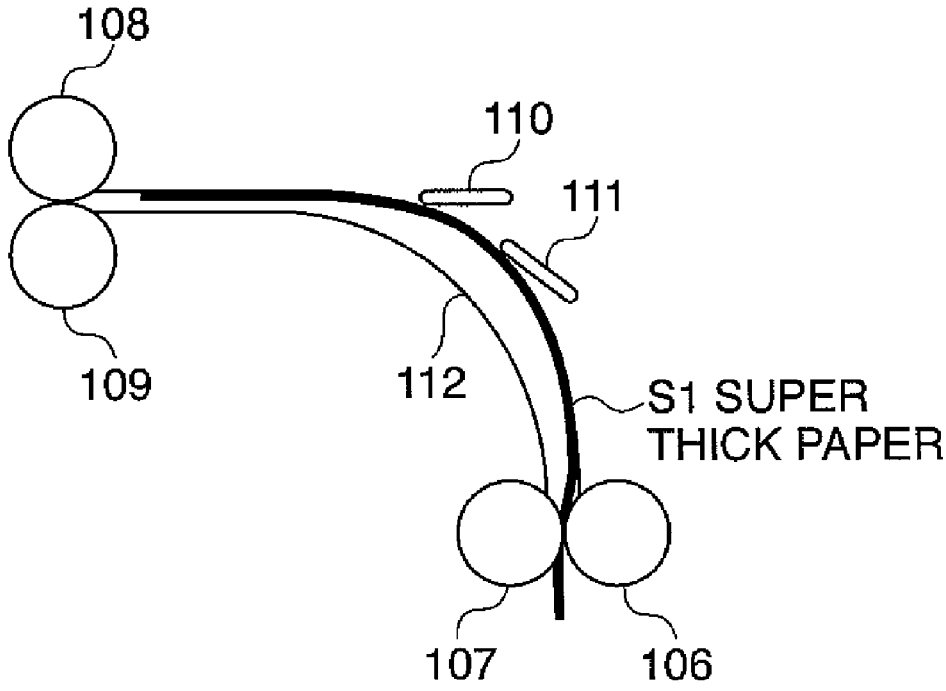
FIGS. 2A and 2B are drawings used to illustrate detection of transfer paper by the image forming apparatus.
Figures 3A, 3B:
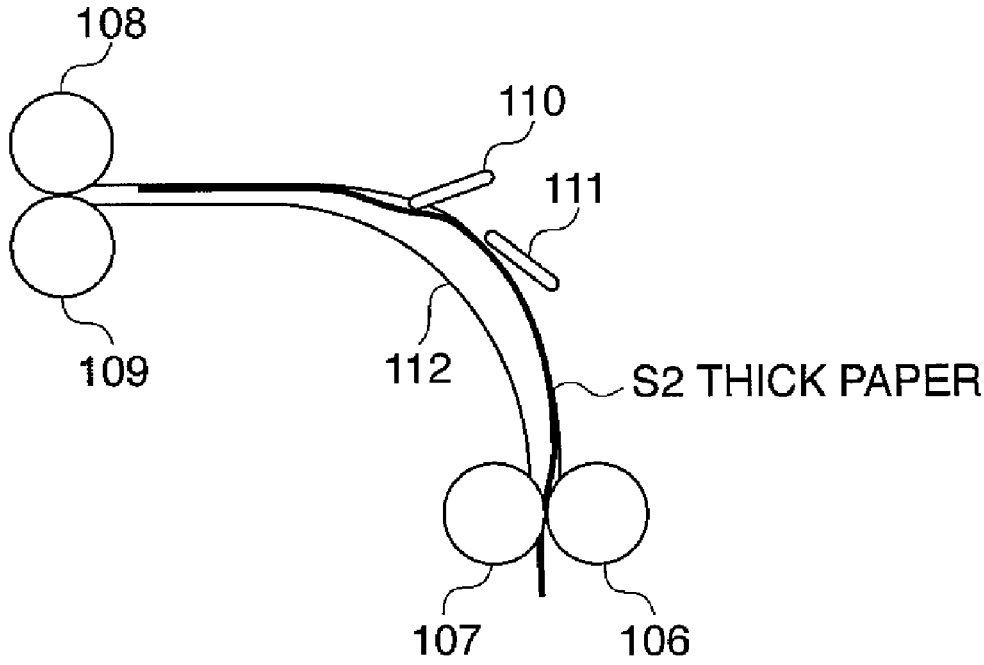
FIGS. 3A and 3B are drawings illustrating the detection of transfer paper by the image forming apparatus.
Figures 4A, 4B:
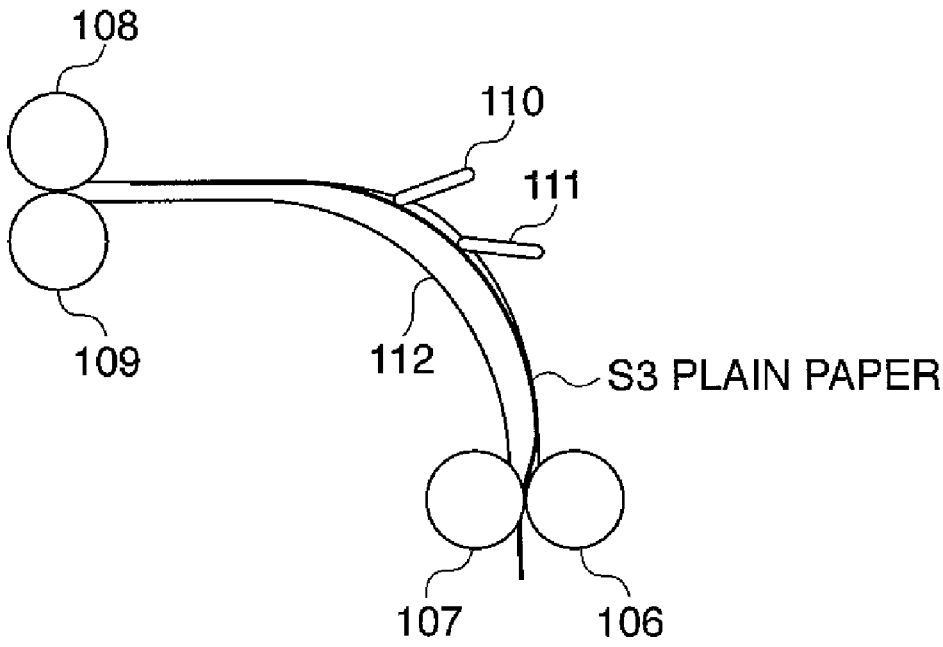
FIGS. 4A and 4B are drawings illustrating the detection of transfer paper by the image forming apparatus.

FIG. 2A is a drawing showing a conveyance state of super thick paper, while FIG. 2B is a drawing showing operation states of the transfer paper detecting sensors. FIG. 3A is a drawing showing a conveyance state of thick paper, while FIG. 3B is a drawing showing operation states of the transfer paper detecting sensors. FIG. 4A is a drawing showing a conveyance state of plain paper, while FIG. 4B is a drawing showing operation states of the transfer paper detecting sensors.

As shown in FIGS. 2A and 2B, if super thick paper is conveyed through the conveying path 112, the transfer paper detecting sensors 110 and 111 both turn to an ON state. As shown in FIGS. 3A and 3B, if thick paper is conveyed through the conveying path 112, the transfer paper detecting sensor 111 turns to an ON state, while the transfer paper detecting sensor 110 remains in an OFF state. As shown in FIGS. 4A and 4B, if plain paper is conveyed through the conveying path 112, the transfer paper detecting sensors 110 and 111 both remain in an OFF state.

Figure 5:
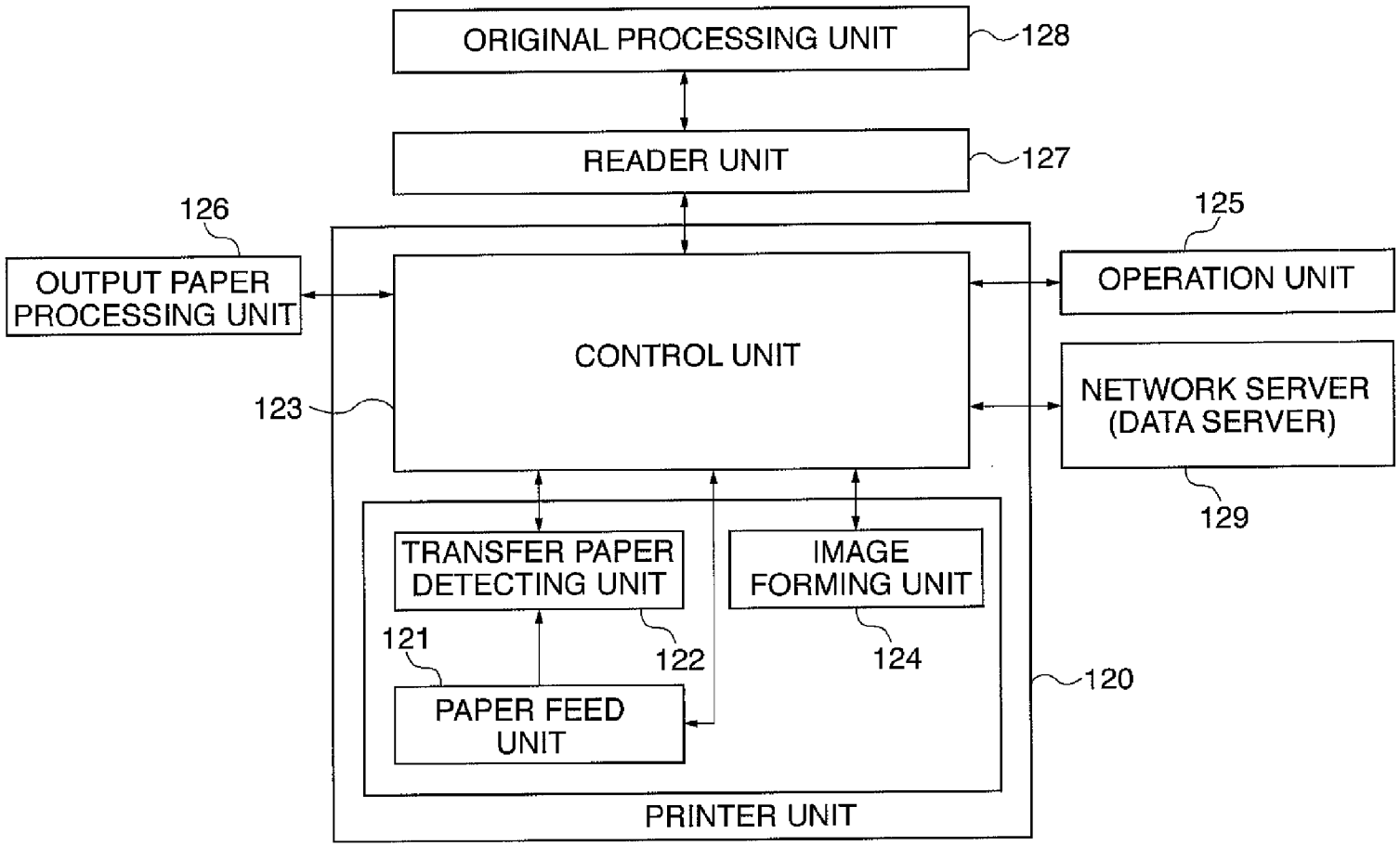
FIG. 5 is a block diagram showing overall configuration of the image forming apparatus.

FIG. 5 is a block diagram showing overall configuration of the image forming apparatus 1.

In FIG. 5, the image forming apparatus 1 comprises an original processing unit 128, a reader unit 127, a printer unit 120, an output paper processing unit 126 and an operation unit 125. Also in the drawing, the apparatus 1 is connected to a network server (data server) 129 to communicate with each other. The printer unit 120 comprises a paper feed unit 121, a transfer paper detecting unit 122, a control unit 123 and an image forming unit 124. The network server 129 monitors usage of the image forming apparatus 1.

The detection of the transfer paper as described in the above with reference to FIGS. 2 to 4 is performed by the transfer paper detecting unit 122. The paper feed unit 121 comprises the paper feed cassette 100, the paper feed rollers 101, 102 and 103 in FIG. 1, and a paper feed roller driving mechanism (not shown). The transfer paper detecting unit 122 comprises the transfer paper detecting sensors 110 and 111 in FIG. 1. The transfer paper detecting unit 122 senses the transfer paper S fed from the paper feed unit 121, and outputs a sensing signal (a signal indicating an ON state or an OFF state) to the control unit 123.

When the control unit 123 recognizes the sensing signal outputted from the transfer paper detecting unit 122, it sets the following control conditions. That is, it sets an image forming condition (for example, a charged power voltage, the density and the like) for the image forming unit 124 to form an image, a driving condition for a driving mechanism used to form the image at an appropriate control (super thick paper control, thick paper control or plain paper control) condition based on the type of the transfer paper. The control unit 123 also executes processing illustrated in flowcharts in FIGS. 7 and 10 described later based on a program. The image forming unit 124 executes the image formation (development, transfer and fixing) based on control by the control unit 123, and then ejects the transfer paper S on which an image has been formed out of the machine.

In order to form an image on the transfer paper S or to output the transfer paper appropriately, the operation unit 125, the original processing unit 128, the reader unit 127 and the output paper processing unit 126 may also be used occasionally. The operation unit 125 is used to set the type of transfer paper in use, the number of copies/the number of prints, single-side recording/both-side recording, and etc. The original processing unit 128 performs original processing such as feed/ejection of an original to be copied. The reader unit 127 reads an image on the original. The output paper processing unit 126 performs post-processing (such as sort processing or staple processing) to eject the transfer paper S on which an image has been formed out of the machine.

Figure 6:
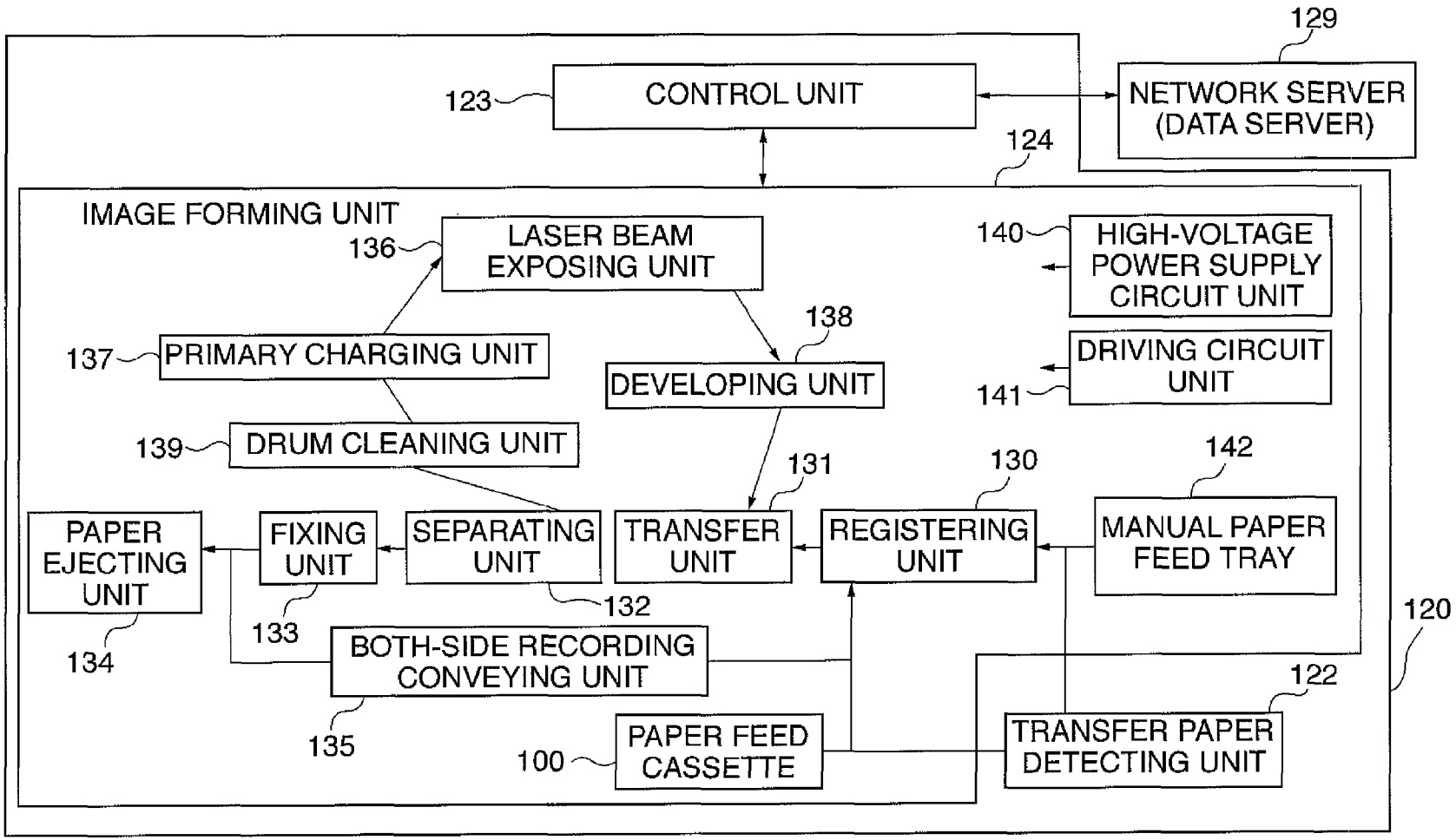
FIG. 6 is a block diagram showing detailed configuration of an image forming unit of the image forming apparatus.

FIG. 6 is a block diagram showing detailed configuration of the image forming unit 124 of the image forming apparatus 1.

In FIG. 6, a laser beam exposing unit 136 exposes a surface of a photosensitive drum (not shown). A primary charging unit 137 charges the photosensitive drum. A developing unit 138 develops a latent image formed on the photosensitive drum with a developer. A drum cleaning unit 139 removes the developer remaining on the photosensitive drum surface. A high-voltage power supply circuit unit 140 supplies high voltage required to form an image such as the charged power voltage of the photosensitive drum. A driving circuit unit 141 drives a driving mechanism (a motor or the like) required to form an image.

The image forming unit 124 changes a control condition for the high-voltage power supply circuit unit 140 or the driving circuit unit 141 based on the type of the transfer paper S (super thick paper, thick paper or plain paper) sensed in the transfer paper detecting unit 122 to form an optimal image. The position of the transfer paper S fed by the paper feed unit 121 is corrected by a registering unit 130. Then, a transfer unit 131 transfers the image onto the transfer paper S, a separating unit 132 separates the transfer paper S, a fixing unit 133 fixes the image on the transfer paper S, a paper ejecting unit 134 ejects the transfer paper S, and then terminates the image forming operation.

When the image forming apparatus 1 forms images on the both sides of the transfer paper S (performs both-side recording), the apparatus 1 conveys the transfer paper S that an image has been formed on its single side (single-side recording has been performed) to the registering unit 130 through a both-side recording conveying unit 135, and then forms an image on the other side of the transfer paper S. The image forming apparatus 1 can also select either cassette paper feed from the paper feed cassette 100 described above or multiple manual paper feed from a manual paper feed tray 142.

Next, the operation in the image forming apparatus 1 configured as above according to this embodiment will be described with reference to FIGS. 1 to 7.

The transfer paper S fed from the paper feed cassette 100 is sent out to the conveying path 112 through the paper feed rollers 102 and 103. The transfer paper S sent out to the conveying path 112 is then sent to the image forming unit 124 via the conveying rollers 104, 105, 106 and 107. This embodiment is designed such that the transfer paper S conveyed through the conveying rollers 106 and 107 curves toward an outer conveying guide through the bent part 112*a* of the conveying path 112.

In other words, this embodiment is designed such that the transfer paper S curves toward the transfer paper detecting sensors 110 and 111 around the bent part 112*a* according to its frictional force against the conveying guide around it, or difference of rotation speeds between the conveying rollers 108, 109 and the conveying rollers 106, 107. The transfer paper S curving toward the outer side around the bent part 112*a* of the conveying path 112 differs in the pushing force against the transfer paper detecting sensors 110 and 111 according to the type of the transfer paper S, particularly according to difference in physical properties of the transfer paper S (such as super thick paper, thick paper or plain paper).

This embodiment is characterized by providing a method of using the pushing force of a side of the transfer paper against the transfer paper detecting sensors 110 and 111 generated according to the difference in the physical properties of the above transfer paper S to easily determine the type of the transfer paper S (super thick paper, thick paper or plain paper). For this purpose, the two transfer paper detecting sensors 110 and 111 are disposed around the bent part 112*a* of the conveying path 112, as described in the above.

Figure 7:
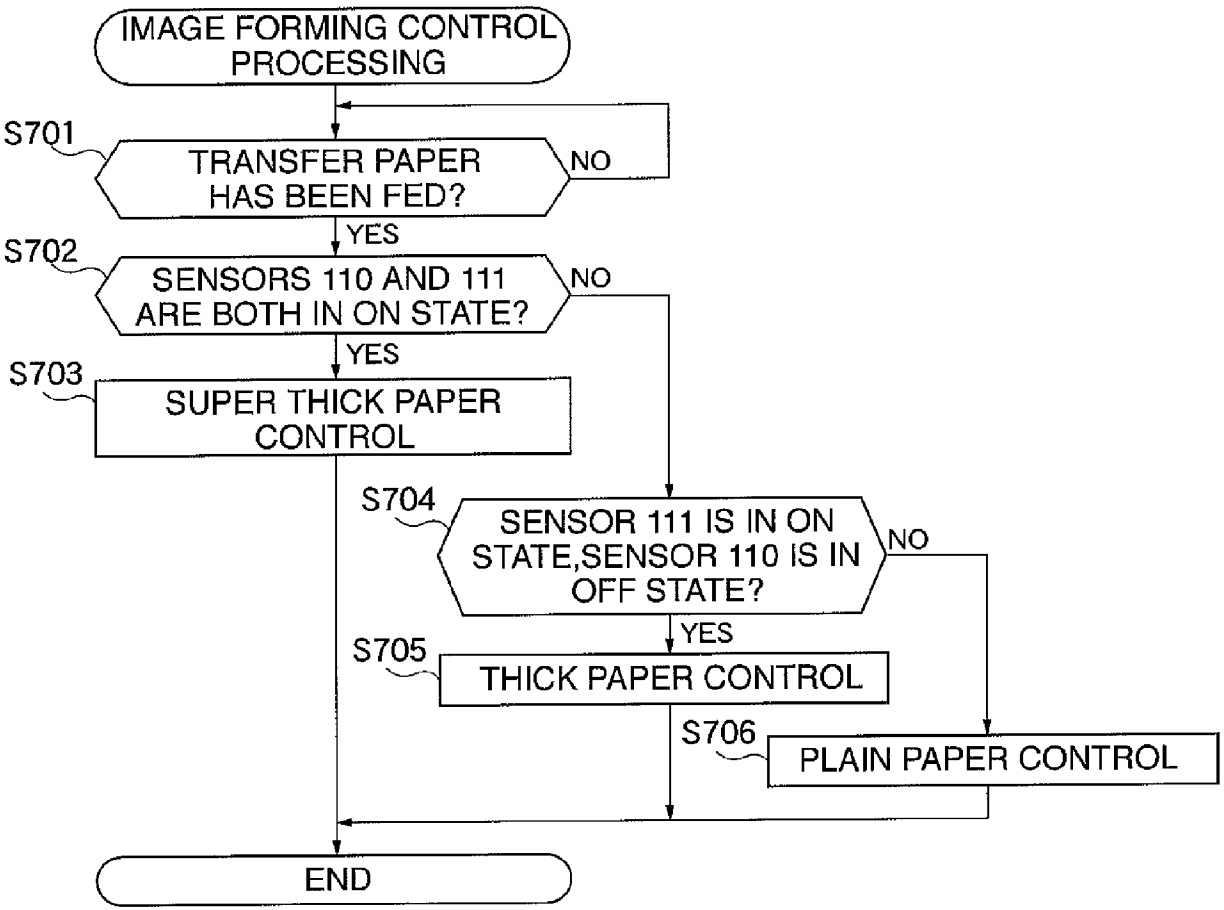
FIG. 7 is a flowchart showing a procedure of image forming control processing based on the detection of transfer paper by the image forming apparatus.

FIG. 7 is a flowchart showing a procedure of image forming control processing based on the detection of transfer paper by the image forming apparatus 1.

In FIG. 7, the control unit 123 of the image forming apparatus 1 determines whether or not the paper feed cassette 100 has fed the transfer paper S into the conveying path 112 (step S701). If the transfer paper S has been fed, the process proceeds to the next processing. As a method of sensing the paper feed of the transfer paper S, any method can be selected including a method of sensing the paper feed using a sensor for sensing rotary driving of the paper feed roller 101. The control unit 123 determines whether or not the transfer paper detecting sensors 110 and 111 both turn to an ON state (step S702) based on an output signal from the transfer paper detecting unit 122 (the transfer paper detecting sensors 110 and 111).

If the transfer paper detecting sensors 110 and 111 both turn to an ON state (YES at step S702), the control unit 123 determines the transfer paper S conveyed through the conveying path 112 as super thick paper. Accordingly, the control unit 123 sets a control condition for the image forming apparatus 1 to super thick paper control (step S703) and terminates the processing. This processing realizes optimal control.

Otherwise, if the transfer paper detecting sensor 111 turns to an ON state and the transfer paper detecting sensor 110 remains in an OFF state (NO at step S702 and YES at step S704), the control unit 123 determines the transfer paper S conveyed through the conveying path 112 as thick paper. Accordingly, the control unit 123 sets a control condition for the image forming apparatus 1 to thick paper control (step S705), and terminates the processing. This processing realizes optimal control.

Still otherwise, if the transfer paper detecting sensors 110 and 111 both remain in an OFF state (NO at step S702 and NO at step S704), the control unit 123 determines the transfer paper S conveyed through the conveying path 112 as plain paper. Accordingly, the control unit 123 sets a control condition for the image forming apparatus 1 to plain paper control (step S706), and terminates the processing. This processing realizes optimal control.

As describe in the above, according to the present invention, the image forming control (super thick paper control, thick paper control, plain paper control) based on the type of transfer paper is performed, thereby allowing for resolving a problem of wrongly setting of the type of transfer paper in use or a problem such as growth in size or increase of cost of a unit for detecting physical properties of transfer paper. The embodiment can also prevent a fault such as paper jam or defective image formation from occurring. This makes it possible to contemplate improvement of the reliability of the image forming apparatus 1 and reduction of life cost charged to a user of the image forming apparatus 1.

Second Embodiment

A second embodiment of the present invention differs from the above described first embodiment in performance of image forming control based on detection of transfer paper shown in a flowchart in FIG. 10. Other elements in this embodiment will not be further described since they are same as those corresponding to the above described first embodiment (FIGS. 1, 5 and 6).

Figure 8:
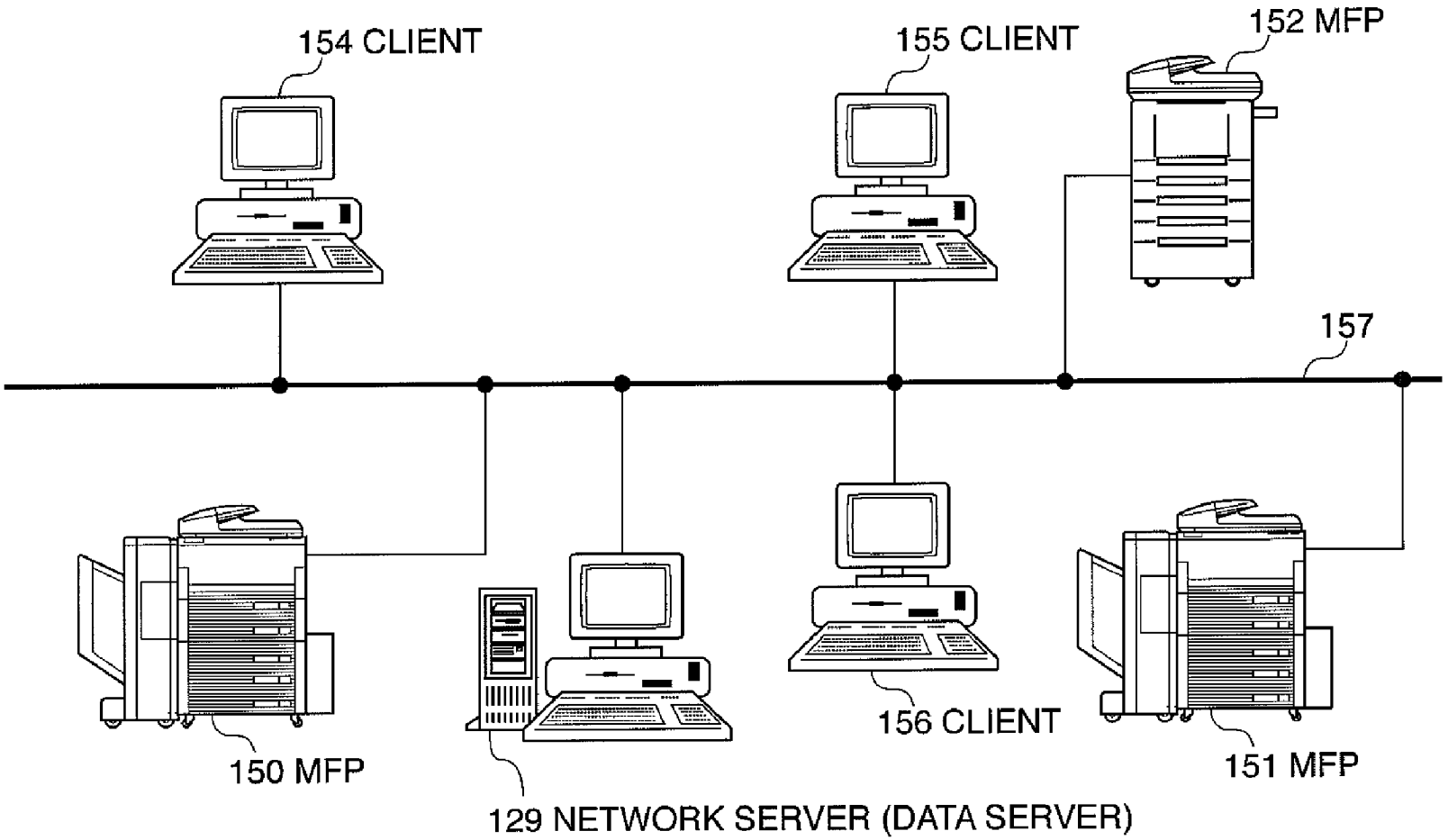
FIG. 8 is a configuration diagram showing connections among image forming apparatuses according to a second embodiment of the present invention, a network server and other information instruments.

FIG. 8 is a configuration diagram showing connections among image forming apparatuses according to this embodiment of the present invention, a network server and other information instruments.

In FIG. 8, a plurality of image forming apparatuses (multi function peripherals) 150, 151 and 152, a plurality of clients (PC) 154, 155 and 156, and the network server (data server) 129 are connected to one another via a network 157. The network 157 can be wired or wireless. Each of the above apparatuses effectively utilizes information of the other apparatuses via the network 157. The network server 129 monitors usage of the image forming apparatuses 150, 151 and 152 (for example, the number of copies/the number of prints or the like of each type of transfer paper). This keeps the image forming apparatuses 150, 151 and 152 in their optimal states.

Figure 9:
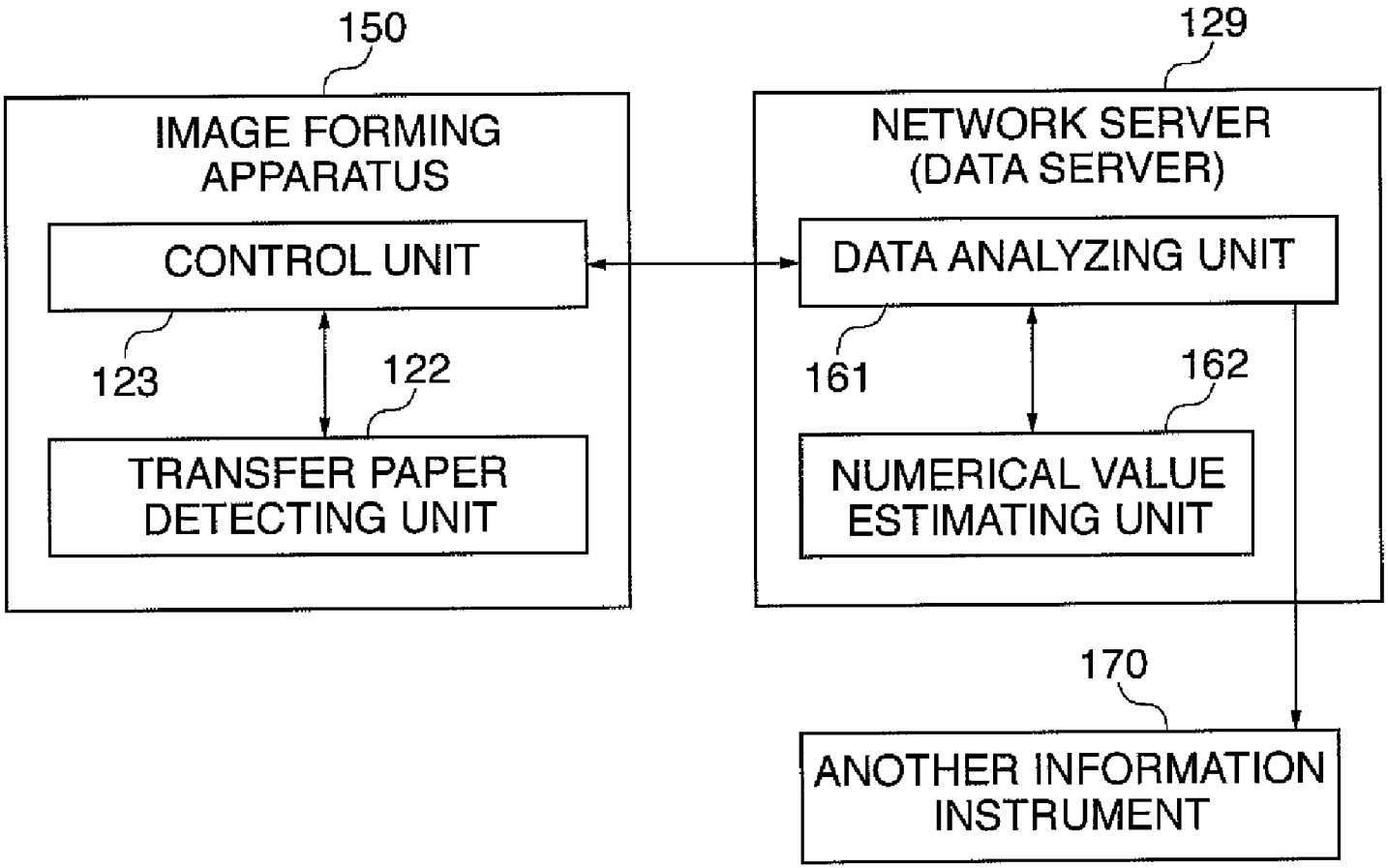
FIG. 9 is a block diagram showing the information flow among the image forming apparatus, the network server and the other information instruments.

FIG. 9 is a block diagram showing the information flow among the image forming apparatus 150, the network server 129 and another information instrument.

In FIG. 9, the control unit 123 of the image forming apparatus 150 performs image forming control processing based on detection of transfer paper described later in FIGS. 10A to 10C, based on a sensing result of the transfer paper detecting unit 122. The control unit 123 also communicates data to/from a data analyzing unit 161 of the network server 129. The data analyzing unit 161 of the network server 129 analyzes data indicating usage of the image forming apparatus 150 sent from the image forming apparatus 150, and outputs the analysis result to a numerical value estimating unit 162.

The numerical value estimating unit 162 estimates the lives of various types of consumable parts (for example, a photosensitive drum, a transfer roller, a fixing roller and the like) used in the image forming apparatus 150. The data analyzing unit 161 sends the estimation result of the lives of the various types of consumable parts by the numerical value estimating unit 162 to the control unit 123 of the image forming apparatus 150. The data analyzing unit 161 also sends usage of the image forming apparatus 150 or the estimation result of the lives of the various types of consumable parts to the another information instrument 170 (the client 154 in FIG. 8 or the like). The other image forming apparatuses 151 and 152 shown in FIG. 8 are also configured similarly to the image forming apparatus 150, so they are not shown in the drawing or further described.

Next, the operation in the image forming apparatus 150 according to this embodiment configured as above will be described with reference to FIGS. 8 to 10.

Figure 10A:
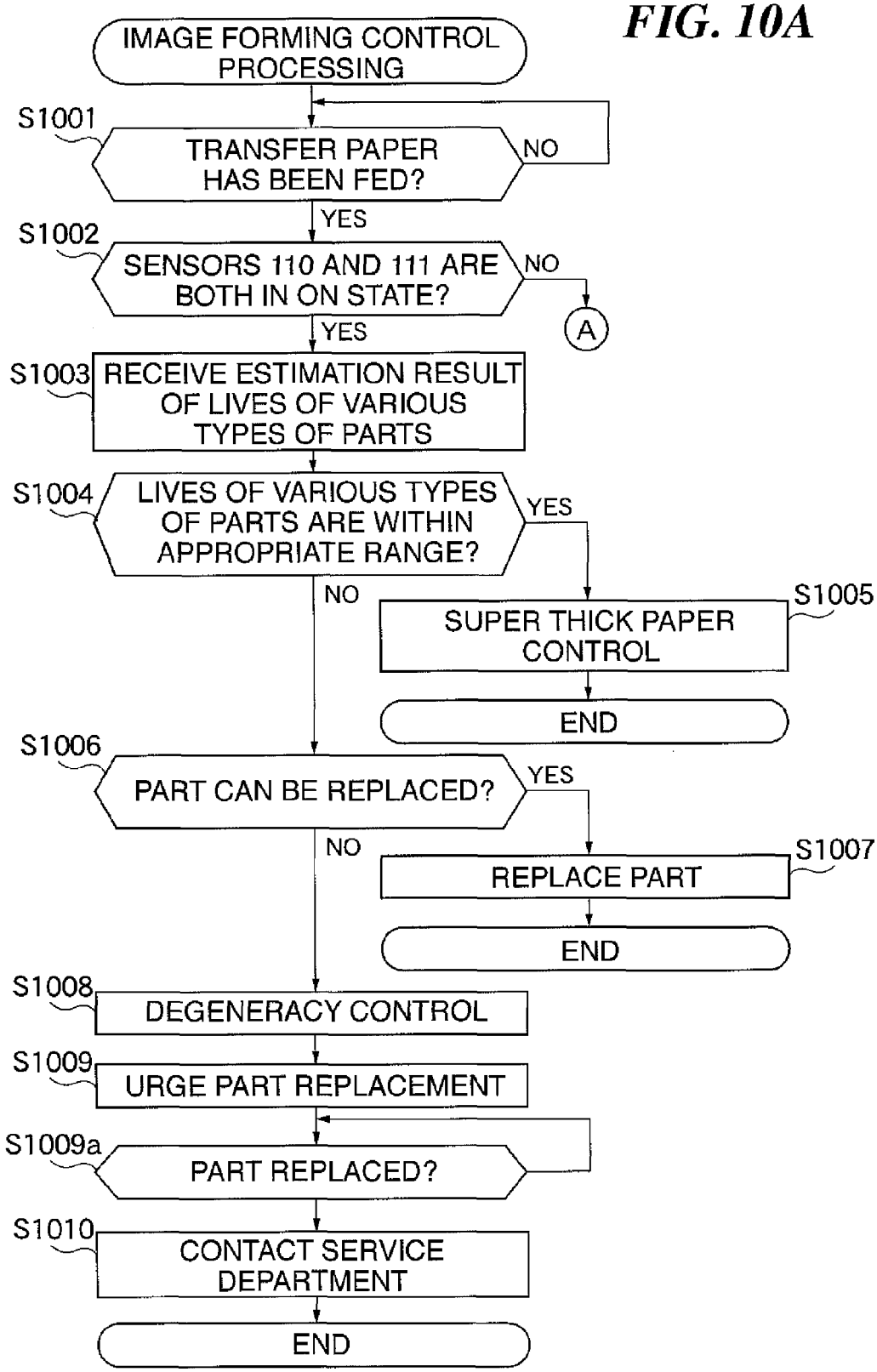
FIGS. 10A to 10C are flowcharts showing a procedure of image forming control processing based on the detection of transfer paper by the image forming apparatus.
Figure 10B:
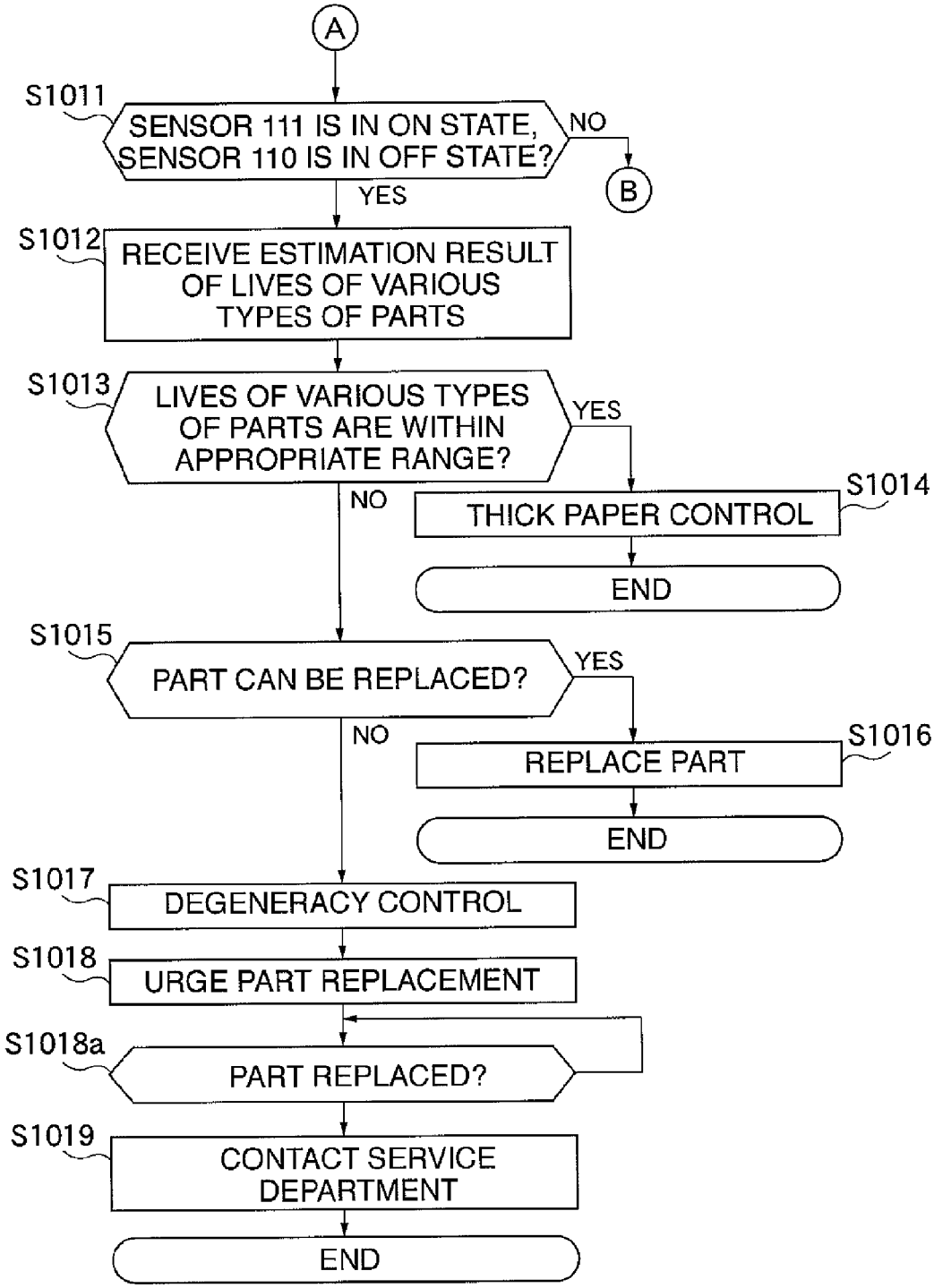
Figure 10C:
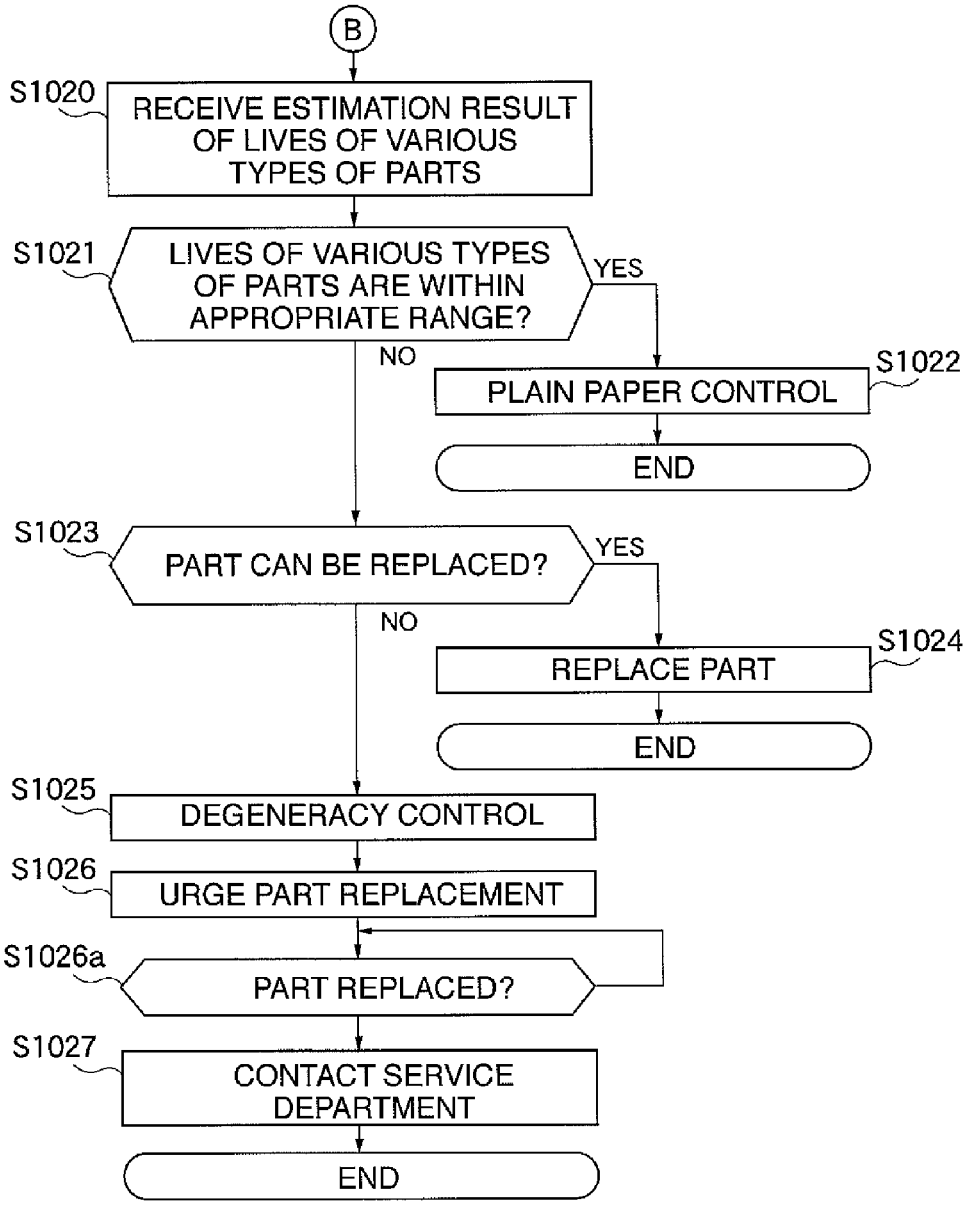

FIGS. 10A to 10C are flowcharts showing a procedure of image forming control processing based on the detection of transfer paper by the image forming apparatus 150.

In FIG. 10, the control unit 123 of the image forming apparatus 150 determines whether or not the paper feed cassette 100 has fed the transfer paper into the conveying path 112 (step S1001). If the transfer paper has been fed, the process proceeds to the next processing. As a method of sensing the paper feed of the transfer paper, any method can be selected including a method of sensing the paper feed using a sensor for sensing rotary driving of the paper feed roller 101. The control unit 123 determines whether or not the transfer paper detecting sensors 110 and 111 both have turned to an ON state (step S1002) based on an output signal from the transfer paper detecting unit 122 (the transfer paper detecting sensors 110 and 111).

The following will describe control by the image forming apparatus 150 and the network server 129 when the conveying path 112 of the image forming apparatus 150 senses super thick paper, while omitting describing control when the conveying path 112 senses thick paper or plain paper. As described in the above, the control unit 123 of the image forming apparatus 150 starts super thick paper control based on sensing of super thick paper by the transfer paper detecting unit 122 (the transfer paper detecting sensors 110 and 111). Another condition to realize optimal control of the image forming apparatus 150 is to keep the lives of various types of consumable parts used in the image forming apparatus 150 in appropriate states.

Estimation of the lives of the various types of consumable parts of the image forming apparatus 150 is performed by the data analyzing unit 161 and the numerical value estimating unit 162 of the network server 129. As such, if it is determined at step S1002 that the transfer paper detecting sensors 110 and 111 both have turned to an ON state, the control unit 123 of the image forming apparatus 150 sends data indicating usage of the various types of consumable parts used in the image forming apparatus 150 and data of various types of control to the network server 129.

The data analyzing unit 161 of the network server 129 analyzes the data sent from the control unit 123 of the image forming apparatus 150, and outputs the analysis result to the numerical value estimating unit 162. The numerical value estimating unit 162 estimates the lives of the various types of consumable parts based on the analysis result. The data analyzing unit 161 sends the estimation result by the numerical value estimating unit 162 to the image forming apparatus 150. The data analyzing unit 161 also sends the estimation result by the numerical value estimating unit 162 to the other information instrument 170 as necessary.

When the control unit 123 of the image forming apparatus 150 receives the estimation result of the lives of the various types of consumable parts from the data analyzing unit 161 of the network server 129 (step S1003), it executes the control based on the estimation result. The control unit 123 determines whether or not the lives of the various types of consumable parts are within an appropriate range (step S1004). If the lives of the various types of consumable parts are within the appropriate range (YES at step S1004), the control unit 123 executes the super thick paper control (step S1005), and terminates the processing. Otherwise, if the lives of the any one of the various types of consumable parts are out of the appropriate range (NO at step S1004), the control unit 123 determines whether or not the consumable part can be replaced (step S1006).

If the consumable part can be replaced immediately (YES at step S1006), the control unit 123 displays a message on the operation unit 125 that it is a time to replace the consumable parts to cause a maintenance staff or the like to replace the consumable part (step S1007), and terminates the processing. Otherwise, if it is difficult to replace the consumable part immediately (NO at step S1006), the control unit 123 executes degeneracy control (image forming control considering any one of the lives of the consumable parts is out of the appropriate range) (step S1008), and the process proceeds to step S1009. By the processing, the control unit 123 performs the best control until the consumable parts are replaced to keep the quality of image forming.

Afterward, the control unit 123 again displays a message to urge the consumable part replacement on the operation unit 125 at a pre-determined time, thereby urging the maintenance staff or the like to replace the consumable part (step S1009). In that case, the image forming apparatus 150 can send a status of the consumable part replacement for the image forming apparatus 150 to the other information instrument 170. If the maintenance staff or the like does not replace the consumable parts yet (YES at step S1009*a*), the control unit 123 communicates with the network server 129 to contact a service department for the image forming apparatus 150 for the consumable part replacement (step S1010), and terminates the processing. The control methods for thick paper and plain paper are similar processing to that for super thick paper, as shown FIGS. 10B and 10C, respectively.

As describe in the above, according to this embodiment, the network server 129 estimates the lives of the consumable parts based on usage of the consumable parts used in the image forming apparatus 150 for appropriate control based on the estimation result, so that the quality of image forming can be kept. This makes it possible to contemplate improvement of the reliability of the image forming apparatus 150 and reduction of life cost charged to a user of the image forming apparatus 150.

Other Embodiments

In the above embodiments, the conveying path 112 is attached with the two transfer paper detecting sensors 110 and 111 for example, but the present invention is not limited to it. The number of transfer paper detecting sensors being arranged can be any number without departing from the spirit of the present invention.

In the above embodiments, the bent part 112*a* of the conveying path 112 is attached with the transfer paper detecting sensors 110 and 111 for example, but the present invention is not limited to it. The transfer paper detecting sensors 110 and 111 can be arranged around any place without departing from the spirit of the present invention.

In the above embodiments, the type of transfer paper is super thick paper, thick paper or plain paper for example, but the present invention is not limited to them. The transfer paper can be any type of paper depending on specifications of the image forming apparatus 150.

In the above embodiments, the image forming apparatus 150 has been described for example, but the present invention can be applied to an instrument comprising a sheet conveying mechanism or an instrument comprising the sheet conveying mechanism and a communication unit.

It is to be understood that the object of the present invention may also be accomplished by supplying a system or an apparatus with a storage medium in which a program code of software which realizes the functions of the above described embodiments are stored, and causing a computer (or CPU or MPU) of the system or apparatus to read out and execute the program code stored in the storage medium.

In this case, the program code itself read from the storage medium realizes the functions of any of the embodiments described above, and hence the program code and the storage medium in which the program code is stored constitute the present invention.

Further, it is to be understood that the functions of the above described embodiments may be accomplished not only by executing the program code read out by a computer, but also by causing an OS (operating system) or the like which operates on the computer to perform a part or all of the actual operations based on instructions of the program code.

Further, it is to be understood that the functions of the above described embodiments may be accomplished by writing the program code read out from the storage medium into a memory provided on an expansion board inserted into the computer or in an expansion unit connected to the computer and then causing a CPU or the like provided in the expansion board or the expansion unit to perform a part or all of the actual operations based on instructions of the program code.

The program may also realize the functions of any of the embodiments described above. The form of the program may be an object code, a program code executed by an interpreter, or script data supplied to an OS (Operating System).

Examples of the storage medium for supplying the program code include a RAM, an NV-RAM, a floppy (registered trademark) disk, an optical disk, a magnetic-optical disk, a CD-ROM, an MO, a CD-R, a CD-RW, a DVD (DVD-ROM, DVD-RAM, DVD-RW, DVD+RW), a magnetic tape, a non-volatile memory card, and other ROMs that can store the program. The program code may also be supplied from a computer, database, or the like, not shown, that is connected via the Internet, a commercial network, a local area network, or the like.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2006-244708 filed Sep. 8, 2007, which is hereby incorporated by reference herein in its entirety.

What is claimed is:

1. An image forming apparatus operable to convey a paper to an image forming unit through a conveying path to form an image, the image forming apparatus comprising:

a plurality of sensing units movable between an actuating position and a retracting position, each respective sensing unit configured to sense a paper by moving from the actuating position to the retracting position caused by the paper touching the respective sensing unit as the paper is conveyed through the conveying path; and a control unit configured to determine a type of paper conveyed through the conveying path based on combination of sensing signals obtained from the plurality of sensing units, and to execute image forming control based on the determined type of paper.

2. The image forming apparatus according to claim 1, further comprising a communication unit configured to communicate with a life estimating apparatus for estimating a life of a component used in the image forming apparatus, wherein the life estimating apparatus performs the life estimation based on the determined type of paper if the communication unit receives information regarding the type of paper determined by the control unit, and the control unit executes image forming control based on the life estimation.

3. The image forming apparatus according to claim 2, wherein a notice of component replacement is displayed based on the life estimation.

4. The image forming apparatus according to claim 1, wherein at least one of the plurality of sensing units senses a paper when a pushing force of the paper against the at least one of the plurality of sensing units is at least a first predetermined value, and wherein at least another of the plurality of sensing units senses a paper when a pushing force of the paper against the at least another of the plurality of sensing units is at least a second predetermined value, wherein the first predetermined value is different from the second predetermined value.

5. The image forming apparatus according to claim 4, wherein each of the first predetermined value and the second predetermined value is adjustable.

6. The image forming apparatus according to claim 1, wherein at least one of the plurality of sensing units is disposed on a peripheral side of a bent part of the conveying path.

7. The image forming apparatus according to claim 1, wherein the control unit sets an image forming condition for the image forming unit forming an image on the conveyed paper and a driving condition for a driving mechanism based on the determined type of paper.

8. The image forming apparatus according to claim 7, wherein the control conditions based on the determined type of paper are selected from at least one of the group consisting a plain paper control condition to form the image on plain paper, a thick paper control condition to form the image on thick paper and a super thick paper control condition to form the image on thick paper that is thicker than the thick paper.

9. A control method for use in an image forming apparatus comprising a plurality of sensing units movable between an actuating position and a retracting position, and the image forming apparatus operable to convey a paper to an image forming unit through a conveying path to form an image, the method comprising the steps of:

sensing a paper by each respective sensing unit moving from the actuating position to the retracting position caused by the paper touching the respective sensing unit as the paper is conveyed through the conveying path; and determining a type of paper conveyed through the conveying path based on combination of sensing signals obtained from the plurality of sensing units.

10. The method according to claim 9, wherein at least one of the plurality of sensing units senses a paper when a pushing force of the paper against the at least one of the plurality of sensing units is at least a first predetermined value, and wherein at least another of the plurality of sensing units senses a paper when a pushing force of the paper against the at least another of the plurality of sensing units is at least a second predetermined value, wherein the first predetermined value is different from the second predetermined value.

11. The method according to claim 9, further comprising the step of:

executing image forming control based on the determined type of paper.

* * * * *